US005343907A

United States Patent [19]

Wagner

[11] Patent Number: 5,343,907

[45] Date of Patent: Sep. 6, 1994

[54] CLEANING DEVICE FOR BEVERAGE DISPENSING SYSTEMS

[76] Inventor: Ewald Wagner, Bachstr. 37b, 5403 Mülheim-Kärlich 1,, Fed. Rep. of Germany

[21] Appl. No.: 929,441

[22] Filed: Aug. 14, 1992

[30] Foreign Application Priority Data

Nov. 5, 1991 [DE] Fed. Rep. of Germany ... 9113750[U]

[51] Int. Cl.[5] ..... B65B 1/04

[52] U.S. Cl. ..... 141/89; 141/90; 134/166; 134/104.1; 137/240; 137/112

[58] Field of Search ..... 141/89, 90, 91; 134/166 C, 167 C, 104.1; 137/240, 112

[56] References Cited

U.S. PATENT DOCUMENTS 578,142 3/1897 Fierz ..... 134/166 C
2,583,982 1/1952 Zwosta et al. ..... 134/166 C
5,090,440 2/1992 Ladouceur et al. ..... 137/240

*Primary Examiner*—Henry J. Recla
*Assistant Examiner*—David J. Walczak
*Attorney, Agent, or Firm*—Evenson, McKeown, Edwards & Lenahan

[57] ABSTRACT

A cleaning device for beverage drafting and dispensing systems, especially dispensing systems for carbonated beverages such as sodas, colas and fruit juices, as well as beer, utilizes primarily water and a liquid chemical cleaning agent which can be induced into the drafting lines from a storage container, and from which it can be removed again after a prescribed settling time. The system includes a hydraulically controlled change valve, controlled via three solenoid valves, pressurized with tap water and enclosed in a valve housing which contains a hydraulically movable piston which, in the operating "tapping" position, provides the first flow. Such flow is intended for the beverage. On the lower part of the valve housing, the beverage container adaptor equipped with a check valve is connected and on the upper part of the housing, a line connection is made with the beverage line leading to the tapping cock. This connection through the device is accomplished by a channel surrounding the piston in the tapping position.

20 Claims, 6 Drawing Sheets

CLEANING DEVICE FOR BEVERAGE DISPENSING SYSTEMS

BACKGROUND AND SUMMARY OF THE INVENTION

The present invention relates to a cleaning device for beverage drafting and dispensing systems, especially dispensing systems for carbonated beverages such as sodas, colas and fruit juices, as well as beer, utilizing primarily water and a liquid chemical cleaning agent which can be induced into the drafting lines from a storage container, and from which it can be removed again after a prescribed settling time.

Such a cleaning device does not presently exist, at least not in the configuration of the present invention with its attendant advantages. A fully automated device is described in applicant's co-pending application, Ser. No. 07/523,428. Although this device is functionally related to the present invention, the former is, however, significantly more complex than .the latter. With the exception of standard, pressurized storage containers for the commercially diluted liquid chemical cleaning agent which can be connected manually to the beverage line to be cleaned, no other devices or apparatus facilitating or easing the handling of the cleaning process of such beverage dispensing systems are known. In reality, the necessary cleaning process for such beverage lines and the associated drafting and dispensing equipment is completely manual. Whenever a particular beverage container is emptied, the operator is required to manually remove the dispensing adaptor and place in on the connecting valves of a new, full container.

Depending on the individual principles of the operating establishment, the recommendations of the manufacturer and/or government regulations, the drafting lines and/or the dispensing system should actually be cleaned during this container exchange process. For the purpose of such cleaning (and assuming that the appropriate pressurized containers with cleaning agent are installed at the site) the dispensing adaptor should actually be connected to the pressurized container containing the liquid, the chemical cleaning agent being properly diluted for the cleaning process. Since the cleaning agent container is properly pressurized, the operator now would return to the tapping cock and initiate the flow of cleaning agent by opening the tapping cock until cleaning agent would flow from the cock. The cleaning agent is generally easily recognizable due to a apparent coloration, e.g. blue.

As soon as such cleaning agent is dispensed, the operator would close the tapping cock again and allow the agent to settle in the beverage line, depending on brand and degree of dilution of the cleaning agent, for 15 to 30 minutes. After that period, the operator returns to the container site, and replaces the adaptor from the pressurized container containing the cleaning agent to a new beverage container which is also pressurized. Upon his return to the tapping cock, the operator again opens the cock, thus allowing the beverage to push out/flush the preceding cleaning agent in the beverage line. When the liquid flowing from the cock resumes the color of the beverage, the operator generally discards several portions of this beverage for safety reasons and for avoiding serving a beverage/cleaning agent mixture. Thereafter, the tapping process resumes normally.

It is easily understandable that the interruption of the regular tapping and dispensing process for such cleaning routines, requiring anywhere between 15 and 35 minutes, is hardly tolerable, especially at peak times and especially when the establishment operates only one tapping line for each type of beverage served. The mere exchanging of an empty beverage containers with a new, full one is interruption enough for the operator (or his customers), especially when the beverage containers are located remotely from the dispensing site, such as in basements, as is often the case.

It is also not very convenient for the operator to perform the cleaning routine for each beverage line at the end of his operating shift, which is many times exhaustive and lengthy, by moving back and forth between container and tapping site three times per line, taking waiting periods of 15 to 35 minutes into account for each line. Due to the expense of the specialized, pressurized container containing the diluted cleaning agent, it is very unlikely that an establishment will maintain one of these containers for each beverage line operated. It is also very unlikely, since in most cases not economically feasible, that any but the largest establishments would afford a separate, dedicated "cleaning operator" whose sole responsibility is the routine cleaning and maintenance of the beverage lines.

The logical consequence in the field is that beverage lines are not, or at least hardly ever, cleaned properly and frequently enough to assure continuous high quality of the beverages dispensed as well as highest possible hygienic status of the equipment and, therefore, compliance with the established government regulations. This is especially negative since the beverages dispensed, e.g., sodas, juices, beer, etc., are essentially food substances, and, as such, are subject to mutations or changes unless specific precautions are taken. These changes, though many times undesirable, are avoidable. One example are the changes caused by enzymes and bacteria when the food or beverage is exposed to air. Whenever these change processes take place in sodas, juices or beer, it results in significant impairment of the quality and noticeable change in taste.

Sodas, juices and beer furthermore contain substances which deposit a slime, skin or layer on the surfaces exposed to the beverage. Infrequent cleaning of such surfaces, e.g. tapping lines, dispensing systems, etc., results in a significant enhancement of such deposits. Regular and frequent cleaning with appropriate liquid chemical cleaning agents, however, results in the removal and the subsequent prevention of such deposits and/or keeps such deposits within negligible tolerances.

With the exception of the traditional method for the cleaning of beer tapping systems used in Germany and other parts of Europe, namely, the use of water and abrasive rubber cleaning balls, the present cleaning process for beverage lines, esp. for sodas, colas and/or juices does not utilize water, and, is not intended to incorporate water as an additional cleaning agent for the tapping lines, the tapping cocks, the container adaptor and/or other parts of the dispensing equipment, unless one manually disconnects the beverage lines and connects the entire system to a water supply.

Sodas and colas especially, however, do contain more or less significant amounts of sugar, glucose or other, similar substances with the specific property of depositing themselves on exposed surfaces even under flowing conditions, not to mention at still condition, and to subsequently crystalize. Primarily sugar crystals have a tendency to deposit on the surfaces of dispensing lines and system components and to develop rather resilient crusts. On the inner surfaces of tapping lines, such crusts may even be tolerated, although they are definitely detrimental to the quality and, sometimes, the dispensing speed of the dispensing process. In particular, excessive foaming of the beverage and excessive and undesirable release of carbonation due to higher flow resistance in the lines take place. Moreover, existing sugar crystals perpetuate the formation of new crystals. These crystals are even more disconcerting where moving parts of the dispensing equipment and/or seals and gaskets are concerned. The friction and/or penetration of the sugar crystals can easily result in blockage of such moving parts, their excessive and premature wear, as well as in leakages.

Based on the above situation and the associated concerns, the present invention provides a device which allows for the automatic, remote-controlled initiation of the cleaning process with a specific, liquid, chemical cleaning agent as well as for the combined, controlled cleaning and/or flushing process with clean tap water.

The above object has been achieved in accordance with the present invention with a cleaning device comprising a hydraulically controlled change valve, controlled via three solenoid valves, pressurized with tap water and enclosed in a valve housing which contains a hydraulically movable piston which, in the operating "tapping" position, provides the first flow. Such flow is intended for the beverage. On the lower part of the valve housing, the beverage container adaptor equipped with a check valve is connected and on the upper part of the housing, a line connection is made with the beverage line leading to the tapping cock. This connection through the device is accomplished by a channel surrounding the piston in the tapping position.

Furthermore, in the operating "cleaning" position, the valve provides for a second flow, such flow being intended for a water/cleaning agent mixture. On the one side of the housing, a line with such mixture is connected to the upper part of the first flow through the device and into the beverage line, while the lower part of the first flow to the beverage container adaptor, and thus into the container, is blocked by moving the piston and thus disconnecting the channel.

Furthermore, an additional hydraulic control connection (tap water connection) is made on the opposite side of the housing. The hydraulic action of the connected tap water is controlled with the three solenoid valves, the pistons of which are retained in the rest position via check valves. These check valves in the rest position provide for a connection via a channel between a valve exit opening and a valve side opening and in the opposite "operating" position, with excited solenoid, provide for a connection via a channel between a valve exit opening and a valve entry opening.

According to another aspect of the present invention, the entry opening of two of the solenoid valves is connected to the pressurized tap water source. The exit opening of one of the two solenoid valves functions as the "tap- or normal position valve," through the hydraulic control connection, and is connected with the side connection of the housing and thus with the piston. The exit opening of the other of the two solenoid valves, functions as the "cleaning- or flushing valve", and is connected to the line carrying the cleaning mixture and thus to the other side connection of the housing or the piston. The cleaning mixture carrying line leads through an adjustable dilution/dispensing device based on the Venturi-principle. The third solenoid valve functions as the "cleaning agent valve", and is integrated between the exit opening of the "cleaning - or flushing valve" and the entry to the dilution/dispensing device to form a by-pass connection to the side opening of the third solenoid valve. The exit opening of the third solenoid valve is connected with the cleaning agent entry opening of the dilution/dispensing device, and its entry opening is connected to a gravity line of a cleaning agent retention container. The side openings of the other two valves are connected with a drain hose. The solenoids of all three valves are connected to a common electrical power supply, allowing the initiation/switching of each valve via a designated switch, preferably located on a switch board near the tapping cock/dispensing site.

The cleaning device of the present invention now allows alternate connection of the tapping line either with the beverage container or the water line depending on the position of the piston. All that is required to do so is the initiation of the switches at the tapping cock which operate the appropriate solenoid valves. This eliminates the cumbersome process of the operator having to move between container and tapping site and to continuously connect and disconnect various lines, in order to, for example, flush a beverage line for cola with water and to keep the line filled with water overnight in order to dissolve possible sugar crystal in the line. This very beneficial process can be accomplished fully automatically with the push of a button.

When the solenoid valve for the chemical cleaning agent is initiated and the piston is moved to the "cleaning" position water will absorb cleaning agent which is injected into the line. The gravity injection is adjustable. The complete filling of the line with the water-cleaning agent solution or mixture becomes evident when colored liquid flows from the tapping cock. The cock can than be closed, allowing the solution to settle in the line for the prescribed lengths of time to complete the cleaning process. By again switching the cleaning valve, the operator can easily flush with clean water, thereby eliminating the need to flush with beverage as is common with the present manual process, and resume the dispensing process at leisure or the next morning, carrying only water in the lines during rest hours. This assures that no valuable beverage is being discarded, a common problem, especially with beer lines, amounting to a sizable amount depending on the length of the lines.

The cleaning device of the present invention for beverage lines assures a time and labor saving cleaning process and allows the cleaning and flushing of any beverage lines at any time. It also results in significant cost savings for the establishment, namely, no beverage loss, no need for specialized, pressurized containers for cleaning agent solution and associated equipment, elimination of regular, professional cleaning services for beer lines; etc. Significant space savings also result due to the elimination of the pressurized containers for cleaning solution and substitution by a much smaller container of concentrated cleaning agent. Due to the use of the Venturi dilution-dispensing device and the fact that the piston is operated by water pressure only, it is required to have a pressure controlled water line on site.

The configuration of the cleaning device of the present invention includes the beverage entering on the bottom and the cleaning liquid entering from the side. The flow principles of the device result in the fact that the lower portion of the device itself, as well as the adaptor to the beverage container, are not being cleaned in the normal process describe above. Although this is a relatively short line, it is still recommended to clean this section occasionally, such as over night or when changing a beverage container.

Another aspect of the present invention is the use of an adaptor integrated into the cleaning process. To perform such a complete or total cleaning process, the adaptor is configured to be removed from the beverage container and connected with a separate receptacle upon which the regular process is performed. To reinitiate the dispensing process, the procedure is reversed.

Another feature of the present invention is the arrangement of the solenoid valves in a functional block unit, allowing on the one side the connection of the adjustable diluting-dispensing device for the cleaning agent while allowing one each connection on the bottom for pressurized clean water or drain water. On top, provisions are made for hydraulic control water (i.e., set water) and hydraulic control water-cleaning agent mixture. In addition, the base block has a combination pipe housing the lines for water, drain and cleaning agent and allowing for the sideward connection of additional devices for the construction of multiline configurations.

Another advantageous aspect of the present invention involves the change valves piston-cylinder which is hydraulically activated. A significant benefit is the fact that the piston is actually activated by the hydraulic action of either the cleaning water itself or the mixture of cleaning water and cleaning agent. This results in the fact that the liquid used is either beverage or cleaning liquid, assuring that no foreign agents are introduced into the system and that all normally floated cavities are consistently cleaned. Depending on the position of the solenoid valve, the piston is activated as a hydraulic cylinder from either side.

In this respect the reliable sealing of the two flows i.e., drafting and cleaning, against each other is critical to avoid any undesirable mixing of the two during the routine dispensing or cleaning process. A good churning and whirling of water and cleaning agent is, however, critical for the effectiveness of the cleaning process. It is important that the water-cleaning agent mixture gushes across the gasket of the piston and then flows through the jet-like gap to reach the area between the throat and the piston bore. The flow through the jet-like gap results in an intensive churning sufficient to assure effective and efficient cleaning of all associated components, and ensuring a continuous exclusion of any encrusting.

The device of the present invention is also equipped with a beverage container connection adaptor with check valve. The lower end of the valve housing is equipped with a bore, which at its upper and narrow end, connects into the vertical bore of the drafting flow. Underneath is a set-bore which incorporates the upper, wider, cylindrical end of an otherwise conical connection piece. This connection piece functions as an abutment for the coil spring and, in its center, has a bore for the pin which disconnects the lower conical nipple resting on the counter surface at the connection piece of the tube jointing sleeve held under pressure of the coil spring by way of an elastic seal. A downward protruding pin on this cone is configured so that it comes to rest on a counter pin of a coupling- or connecting unit or receptacle of the beverage container when the adaptor is locked in place with a quarter-turn fastener. That configuration results in the mutual cancellation of two spring forces, allowing an open flow of beverage through the adaptor and cleaning device. Upon disconnection of the adaptor, the two valves which had been connected via pins, i.e., the one on the beverage container and the one on the change valve, return to the sealed position. This prevents any liquid from escaping the change valve or the dispensing system. Therefore, after the adaptor had been attached to the receptacle and adequately floated with water or cleaning solution, it may then be removed to allow the settling process while disconnected from the receptacle and thus to allow the cleaning of more than one adaptor with only one support receptacle for the process of cleaning entire dispensing multiline systems, a benefit which also saves time. The individual adapters can, after the settling period, be replaced on the beverage containers in which situation the beverage would be used for flushing and rinsing. Alternately, pure water can be used in a renewed cleaning/flushing process after the settling time.

Another key benefit of the present invention is the fact that the device can be used for more than one dispensing lines without requiring extensive additional equipment. One embodiment of such a multiline construction provides that each beverage line requires only the basic change valve as the adaptor to the beverage container while the hydraulic set-water line and the set-water/cleaning agent-line of each change valve are connected to a common base block. The connection of such can be made by appropriate fittings such as multiline distributors, cross pieces or similar devices or it could be configured to provide for T-junctions from one change valve to the next.

In a multiline embodiment of the present invention, switching to, e.g., the "drafting" position would result in all change valves moving into the drafting or dispensing position due to the fact that the appropriate solenoid valves cause the cylinders to change position. With a multiline construction, all interconnected beverage lines are cleaned simultaneously, initiated or controlled from one switch box near the dispensing cocks. This also means that the individual steps in operating the cleaning device (namely, changing positions of cylinders, settling times for the cleaning agent, flushing/rinsing, etc.) would also occur in parallel, thus obviating the necessity to constantly walk back and forth between cock and beverage container for one line at a time. This results in significant time savings and even more operating convenience. Also, there is an increased efficiency of equipment utilization and a corresponding material savings since a multiline configuration only requires the change valve for each beverage line and the necessary connecting lines.

There is also an enhanced flexibility to the system according to the present invention. A multiline configuration does not necessarily require the cleaning of each beverage line connected. Any line within the system may remain uncleaned if desired. As long as the drafting cock for the line in question is not opened during the cleaning operation for the other lines, the original beverage "standing on the line" under $CO_2$ pressure will remain in the line undisturbed. In this manner, a line with rarely dispensed beverage may be cleaned at less frequent intervals, reducing the amount of chemical cleaning agent used.

If the previously described restriction of not dispensing beverage but initiating the cleaning process by opening the drafting cock when the system is switched to the "cleaning" position is undesirable, a further aspect of the system of the present invention resides in the fact that, in the case of multiline dispensing systems, each line, starting with the second line, is equipped with a change valve and an expansion block. Each expansion block, in turn, incorporates a normal position solenoid valve as well as connections for the hydraulic set-water line and the cleaning agent line leading to the appropriate change valve. The expansion block further incorporates fittings to connect to the common water line, drain and cleaning agent line of the base block and/or the adjacent expansion block for the next beverage line. Thus, a direct in-line connection from the base block with the three solenoid valves to an infinite number of expansion blocks exists.

The additional benefit of this system expansion capability is the fact that each expansion block only requires one solenoid valve, the normal position valve. Assuming further that each line now has a separate switch on the central control console to move its piston into the normal or drafting position, it becomes easy to select the lines to be cleaned and the ones not to be cleaned during a particular cleaning process. The construction of this aspect allows for an easy and cost efficient way of expanding the base system by simply interconnecting the appropriate number of expansion blocks.

The present invention also provides for the integration of a separate switch next to each tapping cock of a drafting system. This is entirely optional since the appropriate switches for each line may also be incorporated in the central control console.

BRIEF DESCRIPTION OF THE INVENTION

These and further objects, features and advantages of the present invention will become more apparent from the following detailed description of a currently preferred embodiment when taken in conjunction with the accompanying drawings wherein.

DETAILED DESCRIPTION OF THE DRAWINGS

Figure 1:
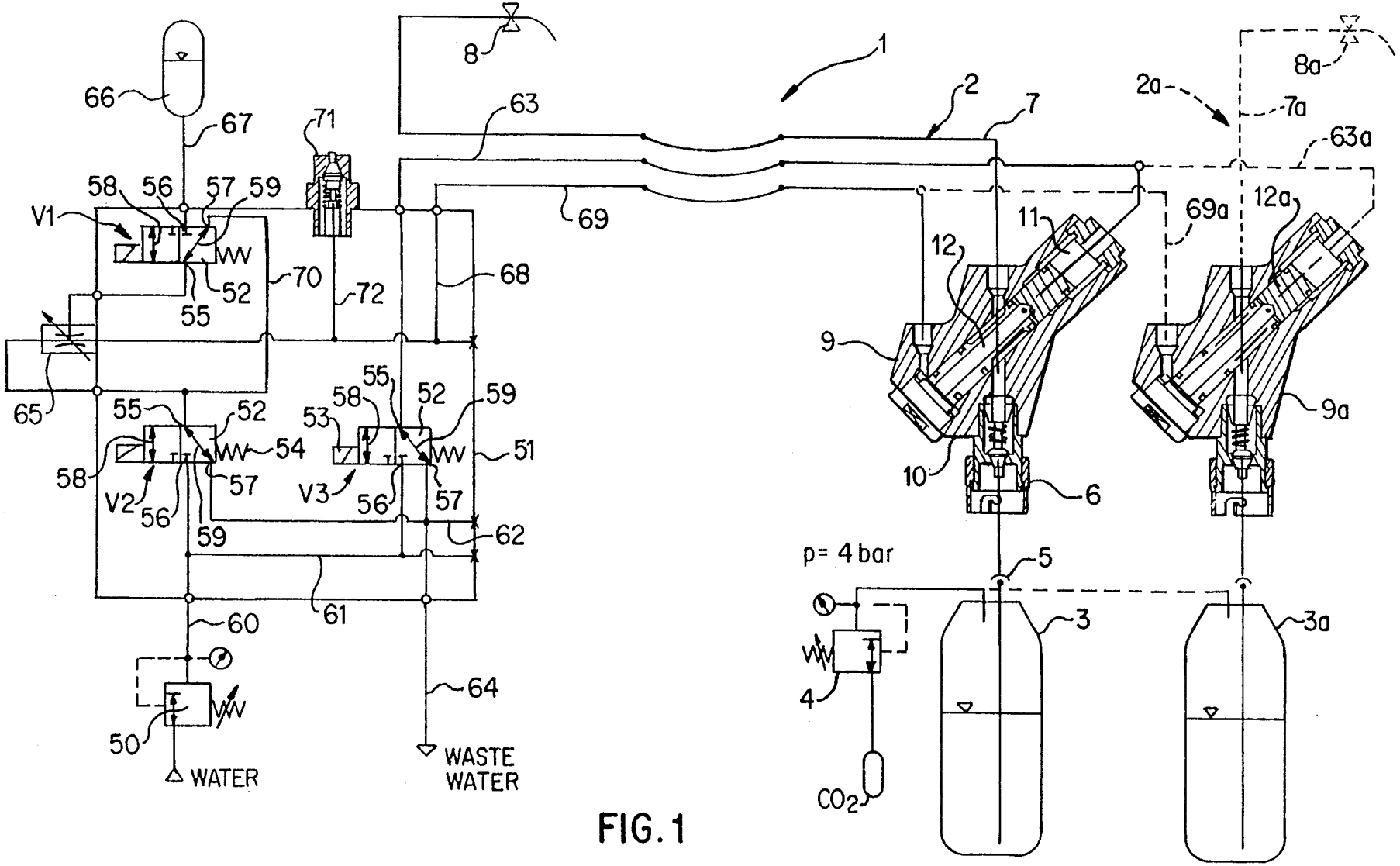
FIG. 1 is a schematic overview of a basic embodiment of the present invention, showing with the broken line a possible expansion for a multiline system.

FIG. 1 shows a cleaning device designated generally by numeral 1 adapted in particular for a beverage drafting or dispensing system 2, predominantly for non-alcoholic soda-type beverages or juices, but which also can be used for beer. The beverage is contained in a beverage container 3 which is pressurized via a $CO_2$ pressurizing system 4. A $CO_2$ pressure of 2 bar is common. The beverage container 3 is equipped with an receptacle 5 which accepts the adaptor 6 of the cleaning device 1 or of the drafting system 2 by way of a quarter turn fastener at the lower end of the drafting line 7. A tapping cock 8 is connected at the upper end of the drafting line 7. By opening the cock 8, the beverage flows under $CO_2$ pressure through the adaptor 6 through the drafting line 7 and out through the cock 8. The drafting process exposes the entire drafting or dispensing system 2 to the ingredients of the beverage, thus allowing the formation of deposits, especially sugar crystalizations or crusts in the case of sodas and juices or fungi in the case of beer. The cleaning device 1 of the present invention prevents or removes such crusts or fungi.

A change valve 9 facilitates the cleaning process with either clear water (rinsing) or with a mixture of a liquid, chemical substance and clear water (cleaning agent - cleaning), or, alternately, the drafting or dispensing of beverage. The drafting line 7 in this case is not, as on previous systems, directly connected with the adaptor to the beverage container, but is now connected with the change valve 9 which, in turn, incorporates the adaptor 6 at its bottom end. The change valve 9 is equipped with a straight vertical drafting channel 10 as seen more clearly in FIG. 2. A drafting channel 10 crosses a piston bore 11 inside the change valve 9 within which a piston 12 moves longitudinally, representing the hydraulic cylinder of the change valve 9. The two axes of the drafting channel 10 and the piston bore 11 cross each other at an acute angle of preferably 30 degrees, but no more than 45 degrees such that the piston 12 of the cylinder reaches its lowest position in the drafting mode and its highest position in the cleaning mode within the bore 11.

The piston bore 11 is located within a valve housing 13 and is enclosed at both ends by plug screws 14 and **14*a*, respectively. The opening of the upper throat plug screw 14 is equipped with central, threaded pipe connection 15. A second threaded pipe connection 16 is located on the side of the housing 13 and leads through a short channel 17 to the inner end of the opening for the lower plug screw 14*a*. The piston 12 has a cylindrical shape and, at its ends, has two surfaces functioning as actuator surfaces, an upper end surface 18 and a lower end surface 19. The two actuator surfaces 18, 19 have, depending on the operating position of the piston 12, flush contact with the respective plug screws 14 (in the upper position) or 14*a* (in the lower position). A second flow direction is defined by flow channel 20 which leads from the short channel 17, or from the preceding threaded pipe connection 16, extending coaxially through the actuator surface 19 of the piston 12 into a central, axial pocket bore 21, to a little more than half of the overall length of the piston 12. The four star-like radial bores 22 to the outside are provided at the pocket end of the channel 20**.

Figure 4:
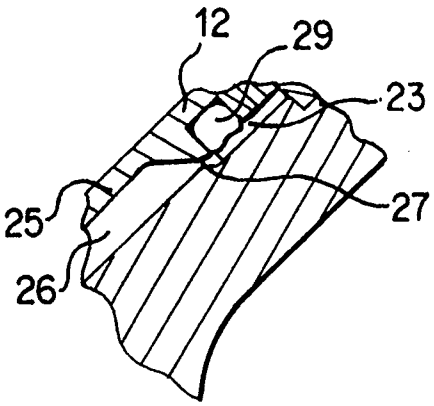
FIG. 4 is an enlarged detail desegregated by the circle in FIG. 3.
Figure 3:
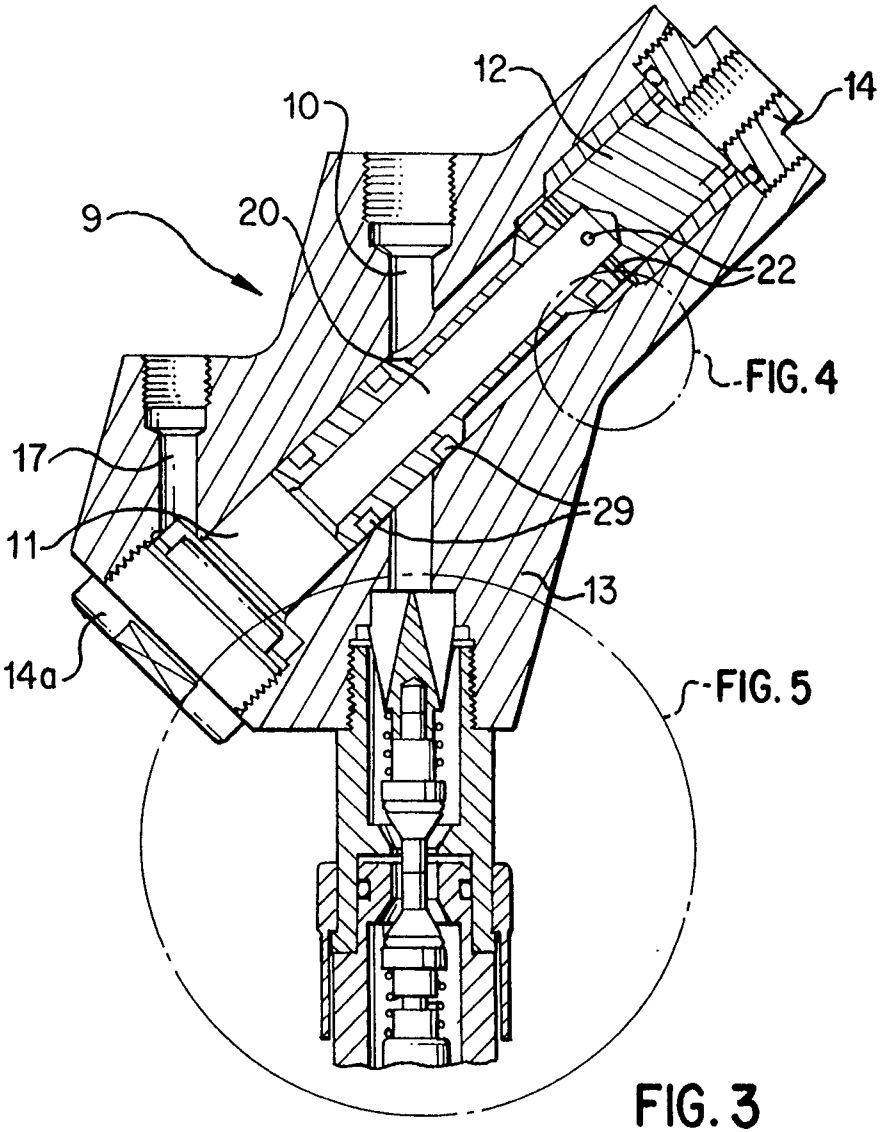
FIG. 3 is a view of the change valve similar to FIG. 2, but with the cylinder in the "cleaning position"

When the piston 12 is positioned in the rinsing or cleaning position as in FIG. 3, the radial bores 22 open to a limited diameter expansion 23 of the piston bore 11 (FIG. 4). Starting from this axially limited diameter expansion 23, the remainder of the piston bore 11 is further turned and the regular diameter of the piston bore 11 up to the threat plug 14 is defined by a bushing 24. The piston 12 is equipped with a cylindrical neck 25 approximately symmetrically to the center of its length, which neck 25 is formed by an also cylindrical diameter reduction rounded at the axial ends. Thus, a ring cavity 26 is formed between the walls of the piston bore 11 and the cylindrical neck 25. This cavity 26 forms the center portion of the flow channel 10 within the piston in the drafting position. In case of the cleaning or rinsing position as shown in FIG. 3, a jet-like gap 27 exists between the cavity 26 and the limited diameter expansion 23, connecting the two areas as shown in FIG. 4. In this manner, the flow channel 20 also leads through the cavity 26 between the cylindrical neck 25 and the walls of the piston bore 11, and then further on via the flow channel 10 into the tap line 7. Therefore, liquid injected under pressure via the connection 16 flows through the flow channel 20 which then has the function of a cleaning or rinsing channel.

To achieve proper sealing, especially a sliding seal, the piston 12 is equipped with a square snap ring groove 28 near its actuator surfaces 18, 19 and on both sides immediately adjacent to the axial ends of the cylindrical neck 25. These grooves 28 carry square gaskets 29. FIG. 4 shows clearly that the jet-like gap 27 is very close to such gaskets 29. The gaskets 29 seal off the drafting flow channel 10 against the access of cleaning or rinsing liquid. The same is achieved on the lower end when the piston 12 is in the cleaning or rinsing position.

Figure 2:
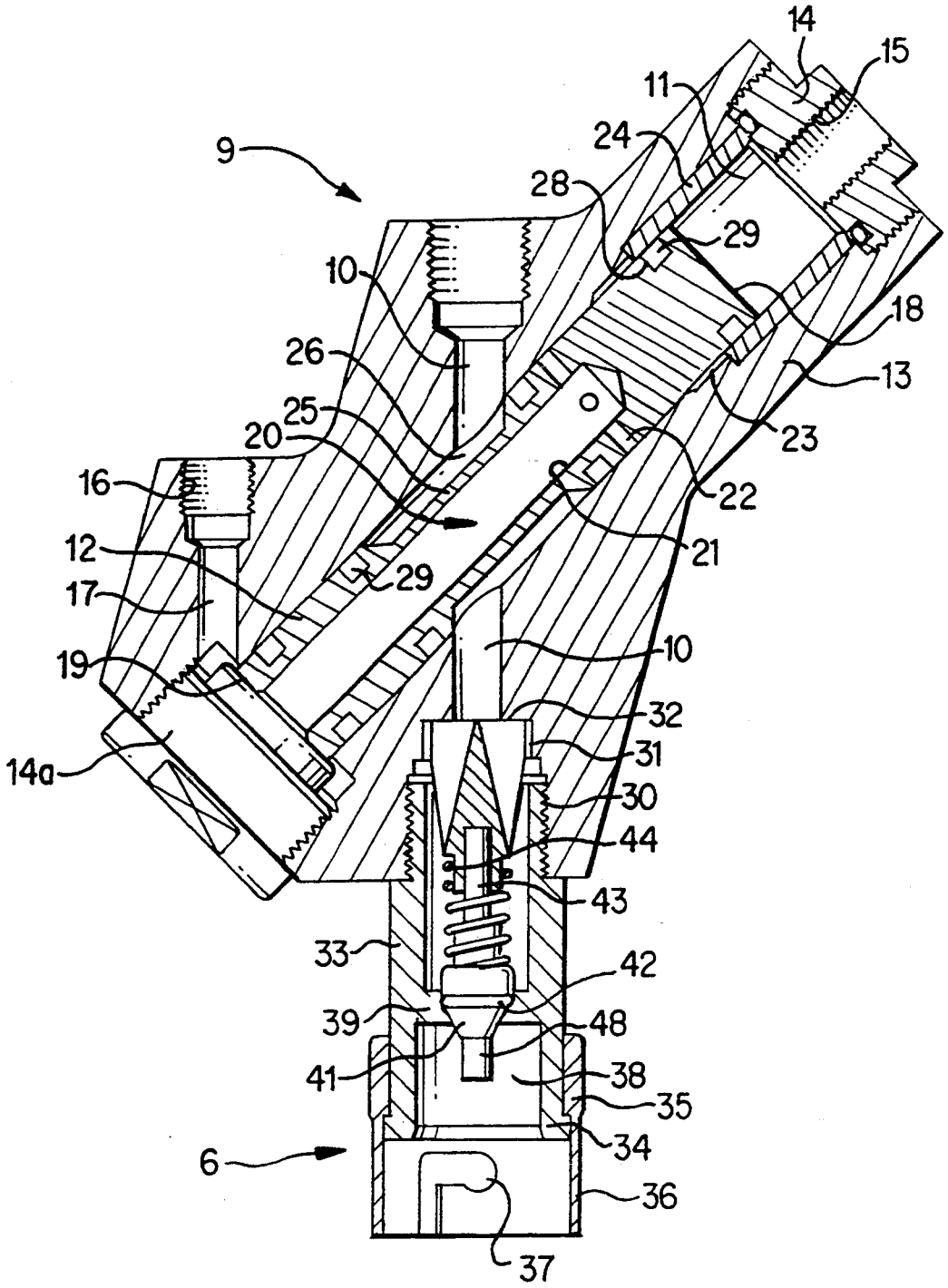
FIG. 2 is an enlarged cross-sectional view of the change valve shown in FIG. 1.
Figure 5:
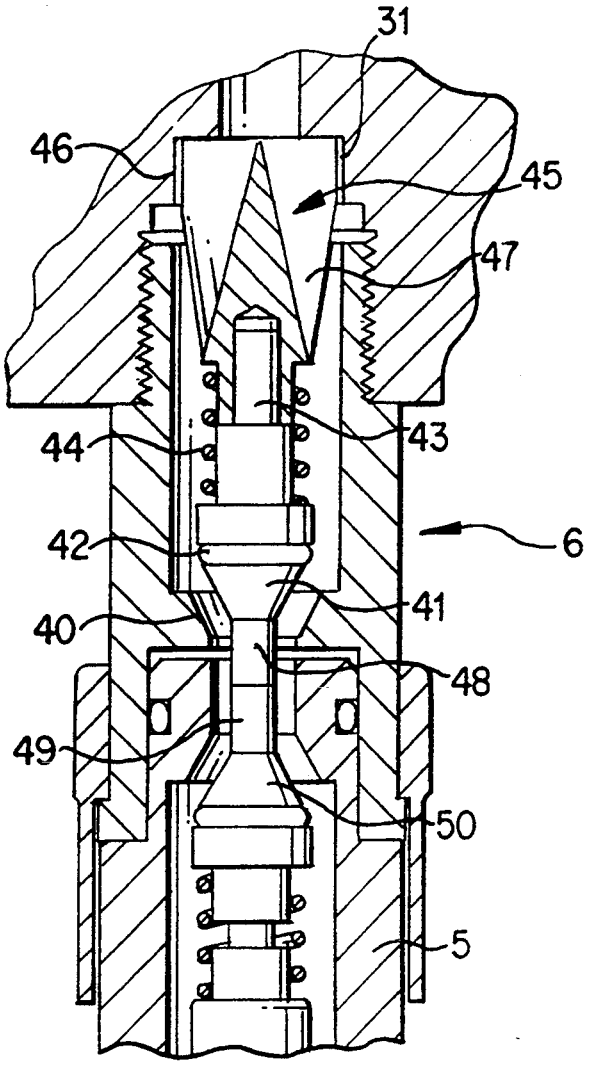
FIG. 5 is an enlarged detail desegregated by the dot dash circle V in FIG. 3, showing the adaptor for the beverage container with the corresponding receptacle on the beverage container in an enlarged cut-away view.
Figure 6:
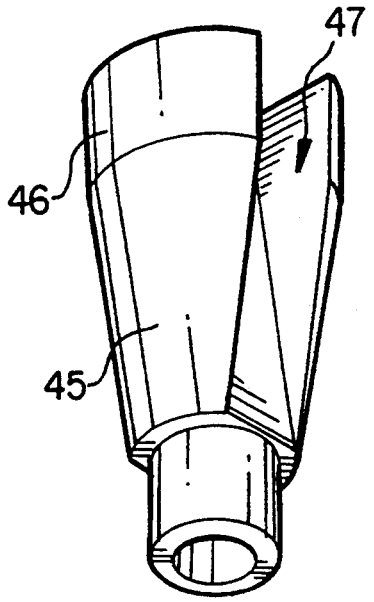
FIG. 6 is an isolated detail perspective view of the adaptor for the beverage container of the change valve as a connecting piece.

The lower end of the drafting flow channel 10 forms the beverage container adaptor 6. FIG. 2 shows the adaptor 6 disconnected from the beverage container 3, and FIG. 5 shows the adaptor 6 connected to the beverage container. To accept the adaptor 6, the housing 13 of the change valve 9 is equipped with a cylindrical bore 31 at the lower end of the drafting flow channel 10 which is centered in the bottom 32 of the bore 31. The open end of the bore 31 connects to a tapped hole 30 with a slightly larger diameter, leading all the way to the exterior surface of the housing 13. A multiply segregated tube sleeve 33, which forms the housing of the adaptor 6, is screwed into the tap 30. At its lower end, which has a larger diameter than the upper threaded end, the sleeve 33 is equipped with a collar 34, acting as tension abutment to the reverse collar 35 of a quick release sleeve 36 which is snapped on to the tube sleeve 33. This quick release sleeve has at least two grooves 37 to accept bayonet pins (not shown) in a known manner on the receptacle 5 of the beverage container 3, allowing a quick, tension loaded connection of the adaptor 6 to the beverage container.

Leading from the collar 34 upwardly, the inside of the tube sleeve 33 has a cylindrical cavity 38 which encloses and seals the counter piece of the receptacle 5 when connected. The cavity 38 is limited at its upper end by an intermediary ridge 39. In the center of this ridge 39 is an upwardly open, conical valve bed 40 which accepts, in the locked position as shown in FIG. 2, a valve cone 41 with gasket 42. The valve cone 41 is conically narrowed toward the lower end and incorporates, at its upper, wider end, a cylinder pin 43 which is encapsulated by a coil spring 44. The spring 44 rests on the upper end of the cone 41, pressing it into the valve bed 40 with the necessary preselected pressure. The upper end of the pin 43 is integrated into the appropriate bore of an intermediary piece 45 which is shaped like a circular cone butt with its lowest diameter at the bottom. The intermediary piece 45 with its lower, smaller circular surface forms the opposite set surface for the coil spring 44. At the wider upper end, the intermediate piece 45 is equipped with a flat cylinder 46 which fits into the cylindrical bore 31 of the housing 13. To provide a flow connection through which beverage can flow along the cone 41 into the drafting flow channel 10, the intermediate piece 45 has at least one notch 47 on the side from the lower end to the center. The valve cone 41 is also equipped with a cylindrical pin 48 at its lower, pointed end. As shown in FIG. 5, the pin 48 presses a counter pin 49 which is part of the receptacle 5. This pressure results into the compression of a valve cone 50 within the receptacle 5 of the beverage container 3 and provides an open beverage flow.

To move the piston 12 within the change valve 9, hydraulic action is required. Cleaning agent or liquid is required to be injected into the system when the change valve 9 is located in the cleaning or rinsing position. As previously mentioned, the actuator surfaces 18, 19 of the piston 12 actuate the hydraulic action of the piston. A major benefit of the present invention is the fact that the liquid required for the hydraulic action at the lower actuator surface 19 is the cleaning or rinsing solution (e.g., water/cleaning agent mixture) itself. Hydraulic medium is tap water from a public water tap which is controlled via pressure valve 50. Thus, a hydraulic medium with constant and pressure is available, i.e. set water or tap water.

The three solenoid valves V1, V2 and V3 are configured to actuate and move the piston 12. The three valves are arranged on a base block 51 shown by the dashed lines in FIG. 1. Each of the solenoid valves has a rod 52 which is retained in the resting position by a pull-back spring 54 opposed by an activated magnet 53. In the rest position, each rod 52 connects a valve exit 55 with a valve side opening 57 via of a channel 59. It furthermore has an additional channel 58 which acts as the connection between valve entry 56 and valve exit 55 when the magnet 53 is activated. A line 60 connects the water pressure valve 50 to the base block 51 and, within the block 51, to a multiple line 61 which is, in turn, connected to the valve entries 56 of the solenoid valves V2, V3. The valve side openings 57 of the valves V2, V3 are connected to a drain 64 which leads from the base block 51 via a multiple line 62.

Valve V3 functions as the tapping or normal position valve. Its valve exit 55 is connected to the pipe connecting thread 15 at the upper plug thread 14 of the change valve 9 via pipes or lines 63 carrying set water. Upon activation of valve V3, pressure controlled set water flows through the line 63 and moves or maintains the piston 12 in the drafting position as shown in FIG. 2. Valve V2 functions as the cleaning or rinsing position valve. Its valve exit 55 connects from the block 51 first to an externally mounted, adjustable cleaning agent injection device 65 for liquid cleaning agents. Such cleaning agent is retained in a storage container 66 from which it gravity-flows via a line 67 to the injection device 65. From the injection device 65, the cleaning-agent-and-set-water-mixture carrying line 69 connects to the side pipe connecting thread 16 at the lower end of the piston bore 11 of the change valve 9. Upon activation of the valve V2, pressure controlled tap water (and assuming, no other steps are taken) flows through the cleaning agent and set water carrying line 69 to the actuator surface 19 of the piston 12, which is in tapping position and thereby moves the piston 12 into the cleaning or rinsing position shown in FIG. 3. Thus, the opposite actuator surface 18 comes to rest over the top of the plug thread 15 and, at the same time, set and rinsing water (in this situation) is permitted to flow via the pocket bore 21 and the radial bore 22 into the drafting channel 10 as previously described, thereby facilitating a rinsing process of the drafting and dispensing system 2 when the tapping cock 8 is opened. Upon closing of the tapping cock 8, assuming the valve V2 is no longer activated, the piston 12 remains in the cleaning or rinsing position, even though the associated magnet 53 may not be activated. Consequently, rinsing water may remain in the entire dispensing system 2, to dissolve any crust or deposit.

If the use of liquid, chemical cleaning agent is desired (preferably in concentrated form) in addition to rinsing with water, the third solenoid valve V1, functioning as the cleaning agent valve, has to be activated in addition to V2. A by-pass line 70, connecting the valve exit 55 of valve V2 with the valve side opening 57 of valve V1, runs parallel to the line leading to the cleaning agent injection device 65. The channel 59 of valve V1 normally connects with the valve exit 55 which, in turn, is interlinked with a Venturi-injector of the cleaning agent injection device 65. Upon activation of valve V1, however, the channel 58 connecting with the valve exit 55 and the valve entry 56, which is connected with the gravity line 67, now allows liquid, chemical cleaning agent to flow into the cleaning agent injection device 65. Consequently, and assuming valve V2 is allowing rinsing water to flow, a controlled amount of cleaning agent is injected into the rinsing water flow, thus forming a mixture of cleaning and rinsing water.

Upon opening of the tapping cock 8, the cleaning agent/water mixture now flows through the system via the tapping channel 10 into the tapping line 7 after it has been intensively agitated by churning through the gaps 27, 26. The arrival of this mixture at the tapping cock 8 becomes apparent when the cleaning agent is colored, e.g. blue. Upon closing of the tapping cock 8 and switching off of valves V1, V2, the piston 12 remains in the cleaning position, and the cleaning mixture remains in the system for the prescribed settling time of about 15 to 30 minutes. Following this, switching on valve V2 again and opening the tapping cock 8 will result in rinsing (water only) of the system, thus flushing out the cleaning agent/water mixture. Following sufficient rinsing of the system 2, valve V2 is deactivated and valve V3 is switched again, moving the piston 12 again into drafting or dispensing position. Upon opening of the tapping cock 8, the beverage flowing from the beverage container 3 will flush the remaining rinsing water from the system. The cleaning process is thereby completed, and regular beverage dispensing may resume.

To provide proper hydraulic action, it has to be assured that the set water between the actuator surfaces 18, 19 and the plug threads **14, 14*a* is properly removed by the piston 12 upon its moving action. If, for example, the rinsing valve V2 is activated while the drafting position valve V3 is in a rest position, the set water line 63 would allow the water pressed out by the piston 12 to flow to the valve exit 55 of V3, and, from there via the channel 59 to the drain 64. The same applies in reverse, when the system is switched from the cleaning or rinsing position into the tapping position. In that situation, remaining rinsing water or cleaning mixture pressed out by the action of the piston 12 has to be able to flow back via line 63 through the valve exit 55 of V2 and via channel 59 into the drain 64**.

The lower part of the drafting channel 10 in the change valve 9, including the adaptor 6, is properly sealed against set water or cleaning mixture to avoid dilution or contamination of the beverage during the above described steps. Therefore, these parts of the system are not cleaned in the normal process. Since crusting or other contamination also develops in these areas, it becomes necessary, from time to time, to perform a so-called "total cleaning". For this purpose, a receptacle 71 is incorporated into the base block 51 which is functionally identical to the receptacle of the beverage container 3. This receptacle is connected to the multiline 68 carrying rinsing and cleaning mixture on the base block 51 via a connecting line 72.

To perform a "total cleaning", the adaptor 6 is connected with the receptacle 71. Upon switching valve V3 into the drafting position and appropriate switching of valves V1, V2, the lower part of the drafting channel 10 and the entire adaptor 6 can be cleaned. Afterwards, the adaptor 6 is reconnected with the receptacle 5 of the beverage container 3. The tight fit of the valve cone 41 assures that no beverage will escape the container 3 and that no cleaning water or mixture can enter the container 3 and dilute or contaminate the beverage. After the system is reconnected, opening of the tapping cock 8 will result in the beverage actually flushing out any remaining rinsing water or cleaning mixture that may have remained in the lower part of the drafting channel 10.

To activate valves V1, V2 and V3, conventional electric connections (not shown) lead, for example, to a switch board or console with appropriate switches for the individual solenoid valves, preferably close to the tapping cock 8 to avoid unnecessary walking by the operator when initiating the cleaning process. For the described "total cleaning," a parallel switch board in the vicinity of the beverage containers 3 is also advantageous.

The above described beverage cleaning device 1 is also suitable to facilitate cleaning of more than one line **2, 2*a*, etc., within a drafting or dispensing system. In that case, each line 2, 2*a*, etc., for each respective beverage container 3, 3*a*, etc., is equipped with its own respective change valve 9, 9*a*, etc. Each change valve 9, 9*a*, etc., is then connected to the solenoid valves via the base system's set water lines 63, 63*a*, etc., and the rinsing and cleaning agent lines 69, 69*a*, etc. The number of change valves 9 and the number of lines interconnected is limited only by the available water pressure for the set water and/or the diameters of the individual lines. Cleaning lines on a multiline system can be either simultaneous or sequential, line by line. Appropriate initiation of the valve V2 will switch the entire system into the rinsing mode. Lines 2, 2*a*, etc., to be cleaned can now be selected by simply opening the appropriate tapping cocks 8, 8*a***, etc. Actuation of the valve V1 will result in the chemical cleaning of all lines selected. Actuation of the valve V3 will resume the drafting position for all lines.

Figure 7:
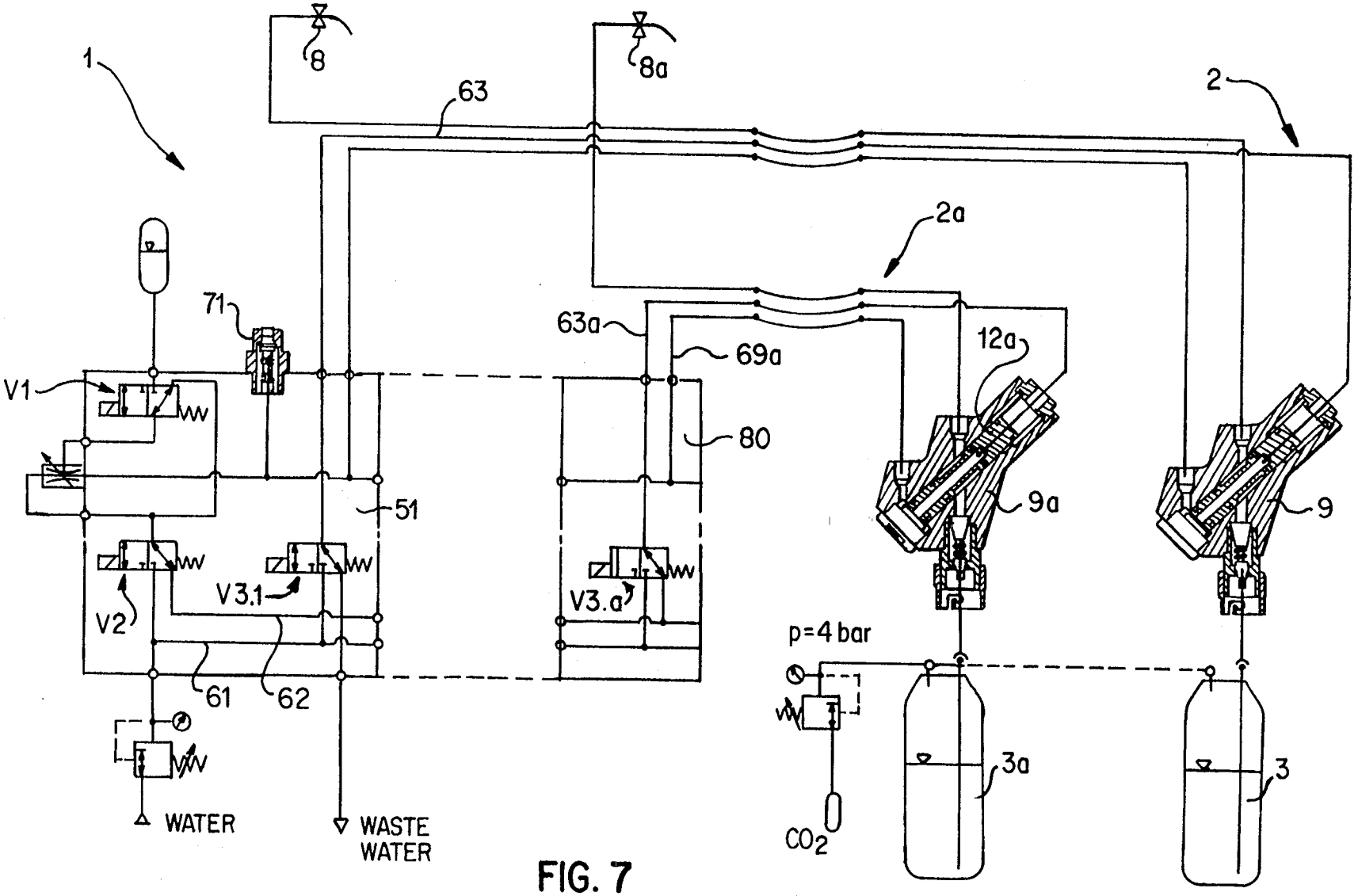
FIG. 7 is a modified embodiment of the system shown in FIG. 1, constituting a multiline cleaning device.

A more elegant but also slightly more comprehensive solution is shown in FIG. 7. This configuration also equips each line **2, 2*a*, etc., with its own change valve 9, 9*a*, etc. Instead of all the change valves 9, 9*a*, etc. being connected to the same base block 51 via line extensions and tap-ins, however, this embodiment associates a separate expansion block 80, etc. to each respective line 2*a* et seq. The expansion block 80, etc., is directly connected to the base block 51 (shown schematically by dotted lines) and is configured to tap into the appropriate lines for set water, drain, etc. by way of conventional quick tap connectors. Additionally, each expansion block 80, 80*a***, etc., is equipped with its own solenoid valve V3*a*, etc., to switch the associated change valve into the drafting position. Set water and cleaning mixture are supplied to the expansion block 80, etc. from the appropriate sources to the base block 51. In this embodiment, separate switches for the valves V3*a*, etc., can also be provided at the switch board.

For the cleaning of only one specific line, e.g. line 2*a*, in the embodiment of FIG. 7, the other lines 2, etc., which are to remain in the drafting position, are secured by switching the appropriate solenoid valves V3, etc., into the drafting position and not switching the one intended to be cleaned, namely V3*b*. Upon initiation of the central rinsing valve V2, the piston 12*a* of the line 2*a* to be cleaned has no counter pressure and will move into the cleaning or rinsing position, thereby allowing rinsing water or cleaning mixture to flow as previously described. This configuration also allows the simultaneous cleaning of more than one, or all, of lines 2 through 2*n*. The benefit of this expanded configuration is the fact that only one additional solenoid valve V3 is required per expansion block, while all other components (pressure valves V1, V2, cleaning agent injection device, cleaning agent container, etc.) are common to the entire system. The "total cleaning" process, however, will have to be restricted to one line at a time since the system is configured for only one receptacle 71.

The described cleaning device has the significant benefit in permitting the remotely controlled, automatic operation of processes which, without the system, would require significant manual steps. The system assures continuous operation in larger drafting systems which provide for two or more lines 2 per beverage type, allowing one to be cleaned (including settling time for the chemical cleaning agent) during normal business hours while continuing to dispense beverage from the other lines. It further more provides for a "total cleaning" of the entire system including the beverage container adaptor 6 and the lower portion of the change valve 9 whenever desired, which would typically be the case when a beverage container 3 is emptied and the operator has to walk to the beverage container location to connect a new, full container for the beverage in question. The cleaning device of the present invention provides a very convenient process, thus assuring the actual cleaning to be executed regularly, i.e. assuring a continuously high quality of beverage and dispensing system, reducing unnecessary wear and avoiding any contamination of the beverages and, therefore, lack of compliance with regulations.

The above described system also allows for the very quick and convenient switching of all lines into a rinsing mode at the end of operation, thus avoiding beverage remaining in the lines during rest times (overnight, etc) and thus significantly reducing the crusting with sugar or the development of fungus in the lines by filling those with clear water.

Although the invention has been described and illustrated in detail, it is to be clearly understood that the same is by way of illustration-and example, and is not to be taken by way of limitation. The spirit and scope of the present invention are to be limited only by the terms of the appended claims.

We claim:

1. A cleaning device for beverage drafting and dispensing systems used with sodas, juices, beer and the like which is adapted to inject a liquid, chemical cleaning agent from a storage container into at least one beverage drafting line and other components of the system and to remove said cleaning agent after a predetermined settling time, comprising a plurality of solenoid valves having rods, a valve exit, a valve entry and a valve side entry, a change valve having a housing and a piston movably arranged within the housing, and operatively controlled, via the solenoid valves, to utilize pressure controlled tap water hydraulically to change position of the piston within the housing between two operating positions; the piston being configured to provide, in one of the operating positions constituting a drafting position, a first flow channel reaching from a beverage container adaptor with check valve at the bottom of the housing through a channel alongside the piston to an upper end of the housing where a first pipe thread adapted to provide a connection to at least one beverage drafting line is located; the piston being further configured to provide, in one of the operating positions constituting a cleaning position, a second flow channel reaching from a second pipe thread on a first side of the housing for a set water and cleaning mixture carrying line to open into the first flow channel while allowing the piston to block the second flow channel from communication with the adaptor for the beverage container; a third pipe thread on an opposite side of the housing operatively associated with a set water line; a water pressure control valve; the solenoid valves having a pull-back spring for retaining the rods in a rest position to provide a connecting channel between the valve exit and valve side entries and having an activatable magnet which provides an operation position in which a connecting channel is arranged between a valve exit and a valve entry; a multiline for operatively connecting the valve entry of two of the halves with the water pressure control valve; the valve exit of one of the valve constituting a drafting line being operatively connected with the third pipe thread of the change valve via said set water line; the valve exit of another of the valves constituting a rinsing valve being operatively connected with the second pipe thread on a side of the change valve via a set water and cleaning mixture line which leads through a cleaning agent injection device having a Venturi-injector system; a by-pass connection operatively arranged between the valve exit of the rinsing valve and the entry to the cleaning agent injection device, leading from the set water line to the valve side entry of another of the valves constituting a cleaning valve, and the valve exit of the cleaning valve is connected via a line with a cleaning agent entry of the cleaning agent injection device, and the valve entry of the cleaning valve is operatively connected to a gravity feed line of the storage container; and the valve side entries of the drafting and rinsing valves being operatively connected to a drain.

2. The cleaning device according to claim 1, wherein said magnets of the solenoid valves are arranged to be activated in a location close to the water pressure control valve.

3. The cleaning device according to claim 1, wherein a receptacle is arranged to accept the beverage container adaptor of the change valve and is connected with the set water and cleaning mixture carrying line via a tap line.

4. The cleaning device according to claim 3, wherein said magnets of the solenoid valves are arranged to be activated in a location close to the water pressure control valve.

5. The cleaning device according to claim 1, wherein the solenoid valves are operatively mounted to a common base block and are connected by pipelines; a receptacle being operatively attached to the common base block; multiple lines for the set water and cleaning mixture as well as for drain; and lines leading between the base block and the change valve being operatively arranged at an edge of the base block for flexible hose connections.

6. The cleaning device according to claim 5, wherein a receptacle is arranged to accept the beverage container adaptor of the change valve and is connected with the set water and cleaning mixture carrying line via a tap line.

7. The cleaning device according to claim 1, wherein the change valve is configured as a two way-two position-valve; the housing of the change valve having, in an installed position, a straight vertical bore constituting the first flow channel which is crossed by a horizontal, substantially cylindrical piston bore, closed off at its ends with threaded plugs and containing the piston having a substantially cylindrical configuration and constituting a positioning device; and a ring cavity which, in the drafting position of the piston is configured to form the center portion of the first flow channel within the change valve.

8. The cleaning device according to claim 7, wherein a receptacle is arranged to accept the beverage container adaptor of the change valve and is connected with the set water and cleaning mixture carrying line via a tap line.

9. The cleaning device according to claim 7, wherein the solenoid valves are operatively mounted to a common base block and are connected by pipelines; a receptacle being operatively attached to the common base block; multiple lines for the set water and cleaning mixture as well as for drain; and lines leading between the base block and the change valve being operatively arranged at an edge of the base block for flexible hose connections.

10. The cleaning device according to claim 1, wherein the second flow channel leading from the second pipe thread for the set water and cleaning mixture carrying line through a straight bore in the housing is positioned immediately adjacent a threaded plug of a bore of the piston, which bore incorporates sliding gaskets, and therefrom through an actuator surface in the piston, into a central, axial pocket bore in the piston; the pocket bore being located coaxially to an axis of the piston, and extending to about more than half of an overall length thereof; a cylindrical neck at an intermediate portion of the piston; a plurality of star-like arranged radially bores arranged between one end of the cylindrical neck and the sliding gasket at another surface of the piston to comprise the second flow channel; openings of the radial bores and the sliding gasket between the radial bores and the cylindrical neck are located, in the cleaning position of the piston, at a diametrically expanded portion of the piston bore via an axially limited gap and a cavity defined between the cylindrical neck and the housing; the second flow channel leading from the radial bores, around the gasket through the diametrically expanded portion and a jet-like gap defined between the piston and the housing into the cavity and, between the cylindrical neck and bore into the first flow channel; and a vertical bore coming from the adaptor into the piston bore is restricted between two of the sliding gaskets, thereby sealing off access to the first flow channel when the piston is in the cleaning position.

11. The cleaning device according to claim 10, wherein a receptacle is arranged to accept the beverage container adaptor of the change valve and is connected with the set water and cleaning mixture carrying line via a tap line.

12. The cleaning device according to claim 10, wherein the solenoid valves are operatively mounted to a common base block and are connected by pipelines; a receptacle being operatively attached to the common base block; multiple lines for the set water and cleaning mixture as well as for drain; and lines leading between the base block and the change valve being operatively arranged at an edge of the base block for flexible hose connections.

13. The cleaning device according to claim 1, wherein from a cylindrical bore in the change valve is configured for acceptance of the beverage container adaptor incorporated into a bottom portion of the housing, from the bottom of which the first flow channel in the form of a straight vertical drafting channel starts; the bore being connected to a tapped hole having a slightly larger diameter than the bore, extending to the exterior surface of the housing; a multiply segregated tube sleeve, screwed into the tapped hole; and provided with a protruding collar at an end thereof to act as a tension abutment to a reverse collar of a quick release sleeve snapped onto the tube sleeve; the lower end of the tube sleeve having a cylindrical cavity which encloses and seals a counter piece of the receptacle of the beverage container and which is limited at its upper end by an intermediate ridge, the center of which is an upwardly open, conical valve bed configured to receive a valve cone having gasket; the valve cone being conically narrowed to a lower end thereof and incorporating at a wide upper end thereof a cylinder pin encapsulated by a coil spring; the spring rests on and presses the upper end of the cone with a selected pressure into a valve bed; an upper end of the pin being integrated into a bore of a circular cone butt shaped intermediary piece with its smallest diameter at a bottom portion; which forms an opposite set surface for the coil spring; a wider upper end of the intermediary piece being equipped with a flat cylinder sized to fit into the cylindrical bore of the housing such that a flow connection is provided through which beverage can flow along the cone with the first flow channel via the intermediary piece having at least one notch on a side from the lower end thereof to the center.

14. The cleaning device according to claim 13, wherein said magnets of the solenoid valves are arranged to be activated in a location close to the water pressure control valve.

15. The cleaning device according to claim 13, wherein a receptacle is arranged to accept the beverage container adaptor of the change valve and is connected with the set water and cleaning mixture carrying line via a tap line.

16. The cleaning device according to claim 1, wherein a change valve is provided for each beverage line to permit automated cleaning of multiple beverage lines within a drafting and dispensing system; and each change valve operatively connects to the base block with a respective set water line and a cleaning mixture line.

17. The cleaning device according to claim 16, wherein the second flow channel leading from the second pipe thread for the set water and cleaning mixture carrying line through a straight bore in the housing is positioned immediately adjacent a threaded plug of a bore of the piston, which bore incorporates sliding gaskets, and therefrom through an actuator surface in the piston, into a central, axial pocket bore in the piston; the pocket bore being located coaxially to an axis of the piston, and extending to about more than half of an overall length thereof; a cylindrical neck at an intermediate portion of the piston; a plurality of star-like arranged radial bores arranged between one end of the cylindrical neck and the sliding gasket at another surface of the piston to comprise the second flow channel; openings of the radial bores and the sliding gasket between the radial bores and the cylindrical neck are located, in the cleaning position of the piston, at a diametrically expanded portion of the piston bore via an axially limited gap and a cavity defined between the cylindrical neck and the housing; the second flow channel leading from the radial bores, around the gasket through the diametrically expanded portion and a jet-like gap defined between the piston and the housing into the cavity and, between the cylindrical neck and bore into the first flow channel; and a vertical bore coming from the adaptor into the piston bore is restricted between two of the sliding gaskets, thereby sealing off access to the first flow channel when the piston is in the cleaning position.

18. The cleaning device according to claim 1, wherein a change valve is provided for each beverage line to permit automated cleaning of multiple beverage lines within a drafting and dispensing system; and, an expansion block per beverage line is provided within which a solenoid valve is operatively arranged for an operative connection to an associated change valve for set water line and cleaning mixture line and mutual multilines for water, drain, and the set water and cleaning mixture carrying line of the base block adjacent thereto and/or an adjacent expansion block.

19. The cleaning device according to claim 18, wherein the change valve in each expansion block is configured for remote operation.

20. The cleaning device according to claim 18, wherein the second flow channel leading from the associated pipe thread for the set water and cleaning mixture carrying line through a straight bore in the housing is positioned immediately adjacent a threaded plug of a bore of the piston, which bore incorporates sliding gaskets, and therefrom through an actuator surface in the piston, into a central, axial pocket bore in the piston; the pocket bore being located coaxially to an axis of the piston, and extending to about more than half of an overall length thereof; a cylindrical neck at an intermediate portion of the piston; a plurality of star-like arranged radial bores arranged between one end of the cylindrical neck and the sliding gasket at another surface of the piston to comprise the second flow channel; openings of the radial bores and the sliding gasket between the radial bores and the cylindrical neck are located, in the cleaning position of the piston, at a diametrically expanded portion of the piston bore via an axially limited gap and a cavity defined between the cylindrical neck and the housing; the second flow channel cleaning from the radial bores, around the gasket through the diametrically expanded portion and a jet-like gap defined between the piston and the housing into the cavity and, between the cylindrical neck and bore into the first flow channel; and a vertical bore coming from the adaptor into the piston bore is restricted between two of the sliding gaskets, thereby sealing off access to the first flow channel when the piston is in the cleaning position.

* * * * *